US005888088A

United States Patent [19]

Kobayashi et al.

[11] Patent Number: 5,888,088

[45] **Date of Patent: *Mar. 30, 1999**

[54] ELECTRICAL CONNECTION CONSTRUCTION OF ELECTRICAL CONNECTION BOX

[75] Inventors: Nobuchika Kobayashi; Yoshiyuki Miyazaki; Takahiro Onizuka; Ryuji Nakanishi; Koji Murakami, all of Yokkaichi, Japan

[73] Assignee: Sumitomo Wiring Systems, Ltd., Yokkaichi, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 600,538

[22] Filed: Feb. 13, 1996

[30] Foreign Application Priority Data

Feb. 22, 1995 [JP] Japan ..... 7-033389
Jun. 19, 1995 [JP] Japan ..... 7-151856

[51] Int. Cl.[6] ..... H01R 4/26

[52] U.S. Cl. ..... 439/404; 439/949

[58] Field of Search ..... 439/76.2, 949, 439/395, 719, 942

[56] References Cited

U.S. PATENT DOCUMENTS

| | | | |
|---|---|---|---|
| 3,172,720 | 3/1965 | Teuscher et al. | 439/709 |
| 4,113,334 | 9/1978 | Instone | 439/96 |
| 4,245,880 | 1/1981 | Zimmerman et al. | 439/650 |
| 4,674,819 | 6/1987 | Fujitani et al. | 439/404 |
| 5,057,026 | 10/1991 | Sawai et al. | 439/76.2 |
| 5,057,033 | 10/1991 | Nadin | 439/397 |
| 5,123,853 | 6/1992 | Gilbert et al. | 439/402 |
| 5,207,587 | 5/1993 | Hamill et al. | 439/76 |
| 5,215,480 | 6/1993 | Lesslie et al. | 439/709 |
| 5,453,021 | 9/1995 | Smith | 439/395 |
| 5,501,605 | 3/1996 | Ozaki et al. | 439/404 |
| 5,525,080 | 6/1996 | Calder et al. | 439/709 |

FOREIGN PATENT DOCUMENTS

| | | |
|---|---|---|
| 1297726 | 6/1969 | Germany . |
| 3543200 | 7/1986 | Germany . |
| 4137425 | 12/1992 | Japan . |
| 5153712 | 6/1993 | Japan . |

*Primary Examiner*—Steven L. Stephan
*Assistant Examiner*—T C Patel
*Attorney, Agent, or Firm*—Greenblum & Bernstein, P.L.C.

[57] ABSTRACT

An electrical connection construction for connecting conductive members of an internal circuit of an electrical connection box and wires of a wiring harness, in which the wires of the wiring harness are inserted into the electrical connection box through openings formed on the electrical connection box such that conductors of the wires of the wiring harness are connected to the conductive members of the internal circuit of the electrical connection box, respectively by a joining member.

14 Claims, 6 Drawing Sheets

ELECTRICAL CONNECTION CONSTRUCTION OF ELECTRICAL CONNECTION BOX

BACKGROUND OF THE INVENTION

The present invention generally relates to electrical connection of electrical connection boxes and more particularly, to an electrical connection construction for connecting, without using a connector, an internal circuit of an electrical connection box such as a junction box and wires of a wiring harness and an electrical connection construction for connecting, without using a connector, internal circuits of electrical connection boxes through wires of a wiring harness.

Conventionally, when wires of a wiring harness are connected to an internal circuit of an electrical connection box such as a junction box, it has been a general practice that terminals are connected to conductors exposed at distal ends of the wires, respectively, so as to be accommodated in a connector, while the connector is fitted into a connector receiver formed on the electrical connection box such that the terminals accommodated in the connector are connected, through relay terminals, to tabs of a bus bar acting as the internal circuit of the electrical connection box. Meanwhile, in the case where the internal circuit of the electrical connection box is constituted by single-conductor wires and pressing contact terminals, the terminals accommodated in the connector are connected to tabs of the pressing contact terminals directly or through relay terminals.

Meanwhile, also when junction boxes 1A and 1B are connected to a wiring harness 6 such that internal circuits of the junction boxes 1A and 1B are connected to each other by the wiring harness 6 as shown in FIG. 1, terminals are, respectively, connected to distal ends of wires of each of branch lines 3 branching off from a main line 2 so as to be accommodated in a connector 4 such that the connector 4 is fitted into each of connector receivers formed on each of the junction boxes 1A and 1B.

Therefore, conventionally, the terminals are, respectively, connected to the distal ends of the wires of the wiring harness so as to be accommodated in the connectors and are connected to the internal circuit of the electrical connection box through the connectors.

Conventionally, since the wires of the wiring harness are connected to the internal circuit of the electrical connection box through the connectors as described above, the connector receivers should be formed on the electrical connection box. In the case of an electrical connection box which is connected to a number of connectors, e.g., a junction box, a number of connector receivers should be formed, so that such problems arise that the electrical connection box becomes large in size and complicated in shape.

Furthermore, conventionally, since the terminals should be connected to the distal ends of the wires of the wiring harness, respectively and should be accommodated in the connector, such inconveniences are incurred that operation is troublesome and the number of the necessary components such as the terminals and the connectors increases, thereby resulting in a rise of the production cost.

SUMMARY OF THE INVENTION

Accordingly, an essential object of the present invention is to provide, with a view to eliminating the above mentioned disadvantages of prior art, an electrical connection construction of an electrical connection box, in which an internal circuit of the electrical connection box and wires of a wiring harness are connected to each other directly without using connectors so as to not only make the electrical connection box compact in size and simple in shape but reduce the number of components without the need for performing an operation of attaching terminals to the wires of the wiring harness, respectively, and an operation of accommodating the terminals in the connector.

In order to accomplish this object of the present invention, an electrical connection construction for connecting conductive members of an internal circuit of an electrical connection box and wires of a wiring harness, in which the wires of the wiring harness are inserted into the electrical connection box through openings formed on the electrical connection box such that conductors of the wires of the wiring harness are connected to the conductive members of the internal circuit of the electrical connection box, respectively by a joining means.

The joining means is welding or is formed by pressing contact terminals.

Meanwhile, the conductive members of the internal circuit of the electrical connection box are, respectively, formed by further wires or bus bars.

BRIEF DESCRIPTION OF THE DRAWINGS

This object and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
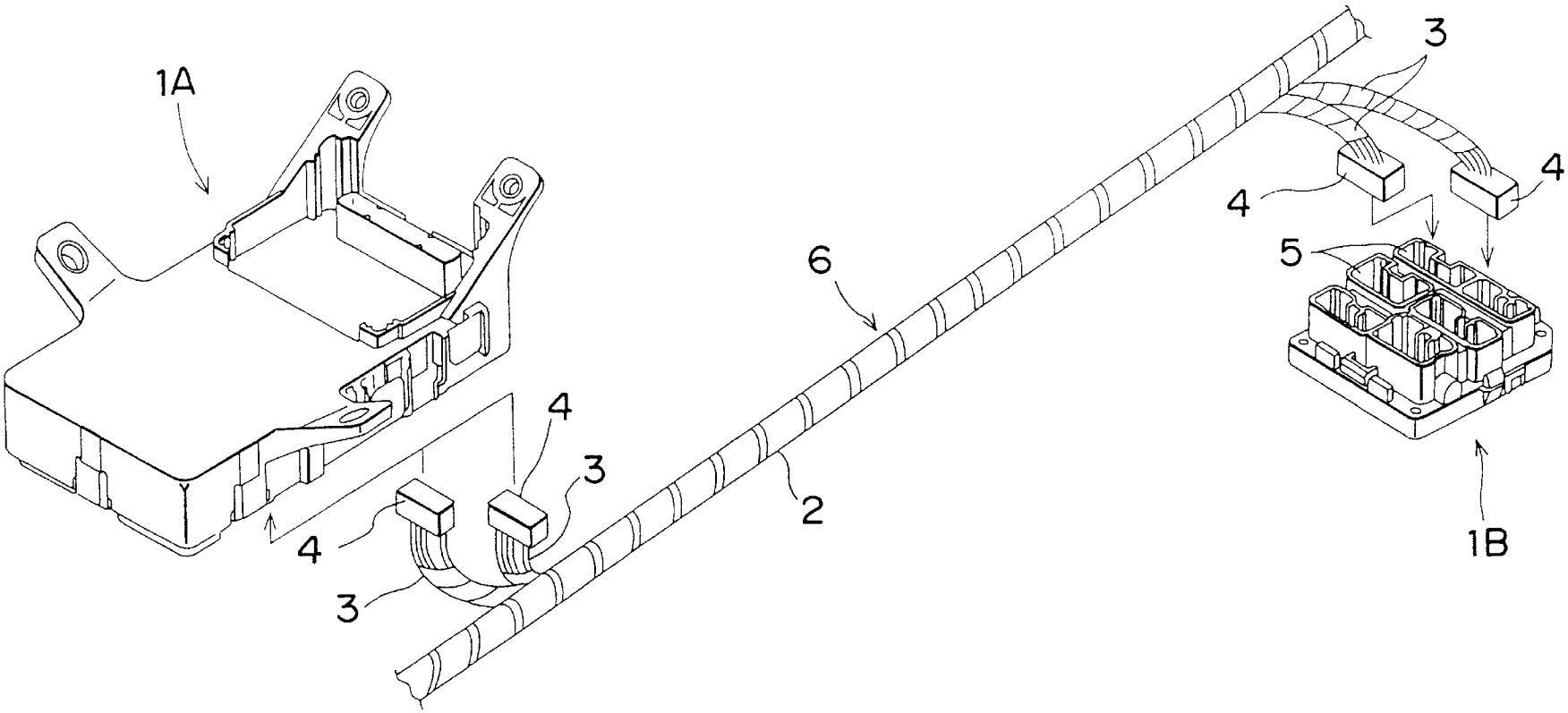
Fig. 1 PRIOR ART
FIG. 1 is a perspective view of a prior art electrical connection construction of an electrical connection box (already referred to)
Figure 2:
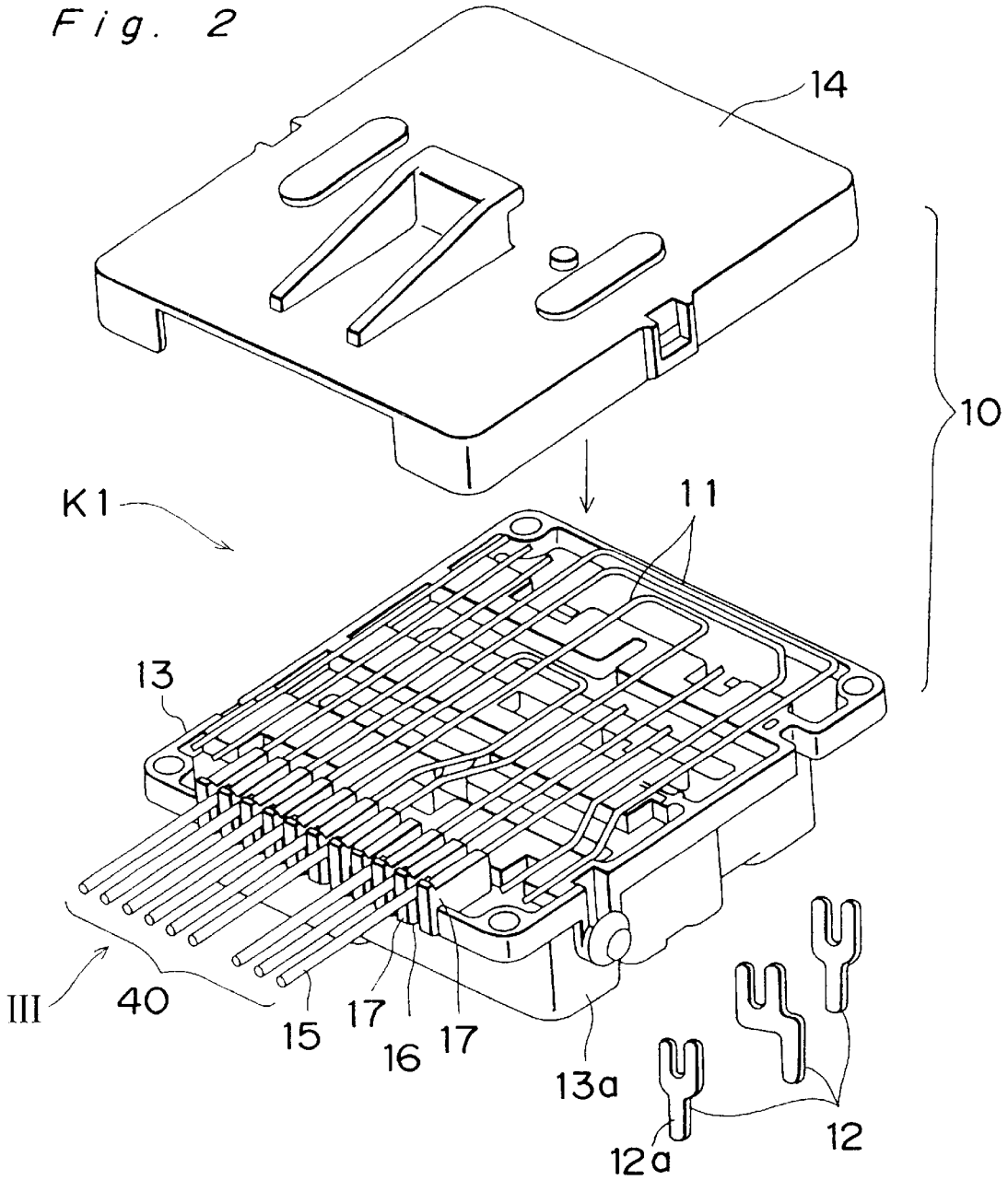
FIG. 2 is an exploded perspective view of an electrical connection construction of an electrical connection box, according to a first embodiment of the present invention.

Referring now to the drawings, there is shown in FIGS. 2 to 6, an electrical connection construction K1 of an electrical connection box 10, according to a first embodiment of the present invention. The electrical connection box 10 is formed by a junction box and an internal circuit of the electrical connection box 10 is constituted by wires 11 and pressing contact terminals 12. The electrical connection box 10 includes an upper casing 13 and a lower casing 14. Thus, the wires 11 are laid on a lower face of the upper casing 13 of the electrical connection box 10 in a state where the electrical connection box 10 is turned upside down as shown in FIG. 2 and pressing contact terminals 12 are driven into the wires 11 so as to be connected to the wires 11.

Each of the pressing contact terminals 12 has a tab 12*a* to be connected to an external terminal, while connector receivers 13*a,* relay receivers and fuse receivers for receiving connectors, relays and fuses, respectively, mounted on the electrical connection box 10 are formed on an upper face of the upper casing 13. The tabs 12*a* of the pressing contact terminals 12 are projected into the connector receivers 13*a,* the relay receivers and the fuse receivers from terminal holes on their bottom faces so as to be connected to the connectors, the relays and the fuses. After the internal circuit of the electrical connection box 10 has been formed by the wires 11 and the pressing contact terminals 12 as described above, wires 15 of a wiring harness 40 are connected to the wires 11 and then, the upper and lower casings 13 and 14 are assembled with each other. As a result, the electrical connection box 10 is obtained.

Figure 3:
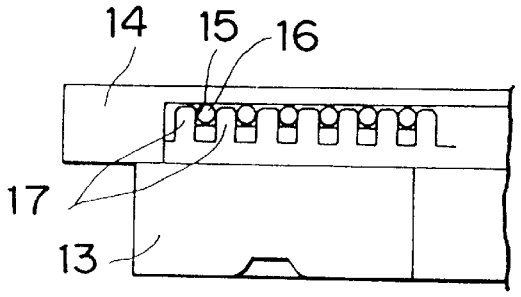
FIG. 3 is a fragmentary view as observed in the direction of the arrow III in FIG. 2.
Figure 4:
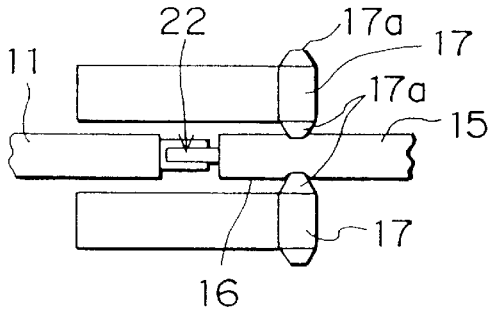
FIG. 4 is a top plan view of a main portion of the electrical connection construction of FIG. 2.
Figure 5:
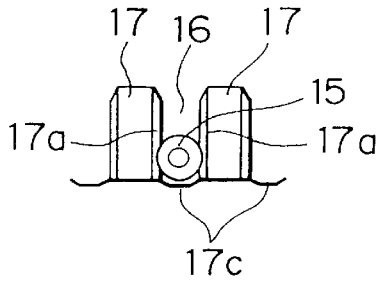
FIG. 5 is a front elevational view of the main portion of FIG. 4.

A plurality of openings 16 for receiving the wires 15 of the wiring harness 40 in parallel with each other are formed in parallel with each other on one side wall of the upper casing 13 of the electrical connection box 10. As shown in FIG. 3 to 5, the openings 16 are provided at a predetermined interval and are each defined by a pair of neighboring ones of a plurality of partition walls 17. Each of the openings 16 has a width substantially equal to an outside diameter of each of the wires 15.

Meanwhile, as shown in FIGS. 4 and 5, a pair of opposed retaining portions 17*a* each having a trapezoidal cross-sectional shape are, respectively, provided on side walls of a pair of neighboring ones of the partition walls 17, with which each of the wires 15 is brought into contact. A pair of the retaining portions 17*a* depress opposite outer peripheral side surfaces of each of the wires 15 so as to prevent each of the wires 15 from being detached from each of the openings 16. Furthermore, an arcuate recess 17*c* is formed on a bottom face of each of the openings 16 and a bottom of each of the wires 15 is fitted into the recess 17*c* such that each of the wires 15 is stably held in each of the openings 16. All the wires 15 constituting a main line of the wiring harness 40 are inserted into the openings 16 of the electrical connection box 10 such that a distal end portion of each of the wires 15 is disposed in the electrical connection box 10.

Figure 6:
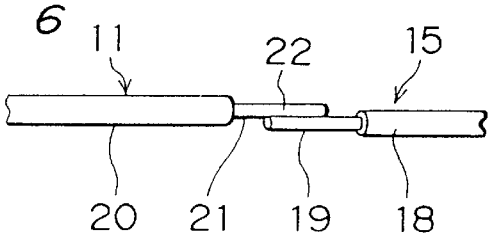
FIG. 6 is a perspective view showing a connection between a wire of an internal circuit of the electrical connection box and a wire of a wiring harness in the electrical connection construction of FIG. 2.

As shown in FIG. 6, an insulating coating 18 is removed from the distal end portion of each of the wires 15 so as to expose a conductor 19. Likewise, an insulating coating 20 is removed from a distal end portion of each of the wires 11 of the internal circuit of the electrical connection box 10, which confronts each of the wires 15 so as to expose a conductor 21. The exposed conductor 19 of the wire 15 and the exposed conductor 21 of the wire 11 are connected to each other by soldering or welding such as ultrasonic welding and electric resistance welding so as to form a joint 22 between the wires 15 and 11.

Since each of the openings 16 has a length rather larger than that of the joint 22, the joint 22 is accommodated in each of the openings 16. Therefore, the joints 22 inserted into the openings 16, respectively, are isolated from one another by the partition walls 17 and thus, are electrically insulated sufficiently by the partition walls 17.

After the wires 11 of the internal circuit of the electrical connection box 10 and the wires 15 of the wiring harness 40 have been connected to each other as described above, the lower casing 14 is mounted on the upper casing 13 and thus, the electrical connection box 10 is obtained. In the above described electrical connection construction K1 for connecting the electrical connection box 10 and the wiring harness 40, the wires 15 of the wiring harness 40 and the wires 11 of the internal circuit of the electrical connection box 10 can be connected to each other without using a connector.

Figure 7:
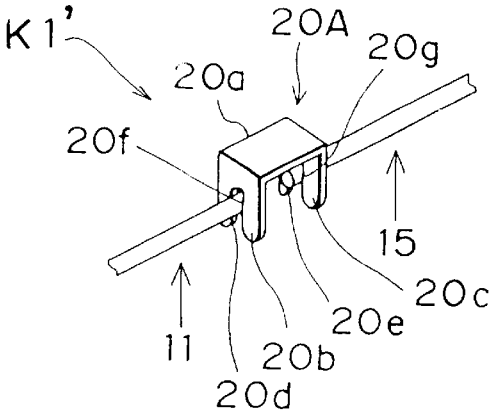
FIGS. 7, 8 and 9 are perspective views similar to FIG. 6, particularly showing first, second and third modifications of the electrical connection construction of FIG. 2, respectively.
Figure 8:
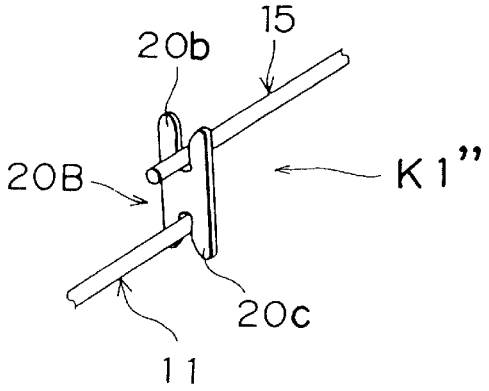
Figure 9:
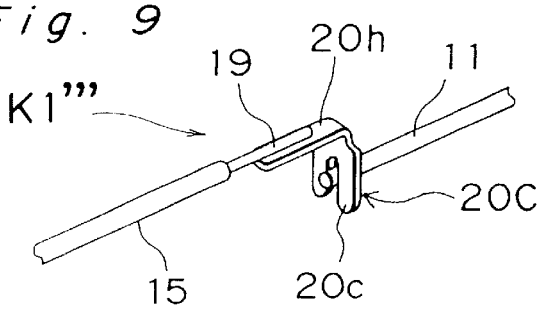

FIGS. 7, 8 and 9 show first, second and third modifications K1', K1" and K1"' of the electrical connection construction K1 of FIG. 2, in which the wire 15 of the wiring harness 40 and the wire 11 of the internal circuit of the electrical connection box 10 are connected to each other through pressing contact terminals 20A, 20B and 20C, respectively. In the pressing contact terminal 20A in the electrical connection construction K1' of FIG. 7, opposed pressing contact portions 20*b* and 20*c* are bent downwardly from opposite ends of a horizontal intermediate plate portion 20*a,* respectively, and downwardly opening slots 20*d* and 20*e* are formed in the pressing contact portions 20*b* and 20*c,* respectively such that pressing contact blades 20*f* and 20*g* are, respectively, formed by peripheral surfaces of the slots 20*d* and 20*e*. Therefore, when the pressing contact terminal 20A is driven into the wires 11 and 15 confronting each other such that the pressing contact blades 20*f* and 20*g* of the pressing contact portions 20*b* and 20*c* are brought into pressing contact with the conductors 21 and 19 of the wires 11 and 15, respectively, the wires 11 and 15 can be connected to each other through the pressing contact terminal 20A.

In the electrical connection construction K1" of FIG. 8, the pressing contact terminal 20B is formed by a vertical flat plate and the pressing contact portions 20*b* and 20*c* are provided at upper and lower end portions of the pressing contact terminal 20B, respectively. Therefore, the distal end portions of the wires 11 and 15 are provided in the pressing contact terminal 20B so as to confront each other such that the wires 11 and 15 are held out of alignment with each other vertically. Then, the pressing contact portions 20*b* and 20*c* are, respectively, brought into pressing contact with the wires 15 and 11 so as to connect the wires 15 and 11.

Meanwhile, in the electrical connection construction K1"' of FIG. 9, the pressing contact terminal 20C includes the pressing contact portion 20*c* and a horizontal flat plate portion 20*h* which are provided at a lower end portion and an upper end of a vertical flat plate portion, respectively, such that the pressing contact portion 20*c* is brought into pressing contact with the wire 11 of the internal circuit of the electrical connection box 10. The conductor 19 of the wire 15 of the wiring harness 40 is exposed in advance by removing the insulating coating 18 from the distal end portion of the wire 15 of the wiring harness 40 and is brought into contact with the flat plate portion 20*h* so as to be secured to the flat plate portion 20*h* by soldering or welding, such as ultrasonic welding and electric resistance welding.

Figure 10:
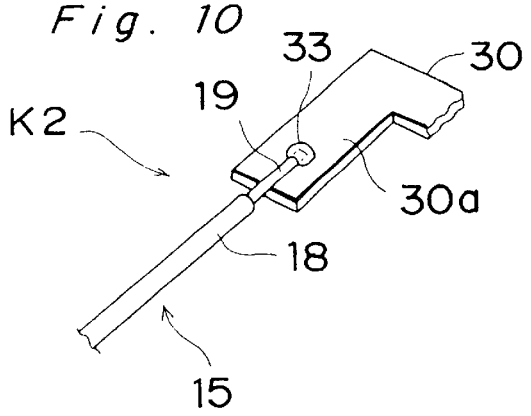
FIG. 10 is a perspective view showing a connection between a bus bar of an internal circuit of an electrical connection box and the wire of the wiring harness in an electrical connection construction of the electrical connection box, according to a second embodiment of the present invention.

In the first embodiment referred to above, the internal circuit of the electrical connection box 10 is constituted by the wires 11 and the pressing contact terminals 12. FIG. 10 shows an electrical connection construction K2 according to a second embodiment of the present invention, in which the internal circuit of the electrical connection box 10 is constituted by bus bars 30 each formed by blanking an electrically conductive metal plate. In FIG. 10, an external terminal portion 30*a* is formed by a horizontal flat plate portion disposed at a portion of the bus bar 30 and the conductor 19 exposed at the distal end portion of the wire 15 of the wiring harness 40 is connected to the external terminal portion 30*a* of the bus bar 30 by solder 33 or welding such as ultrasonic welding and electric resistance welding.

Figure 11:
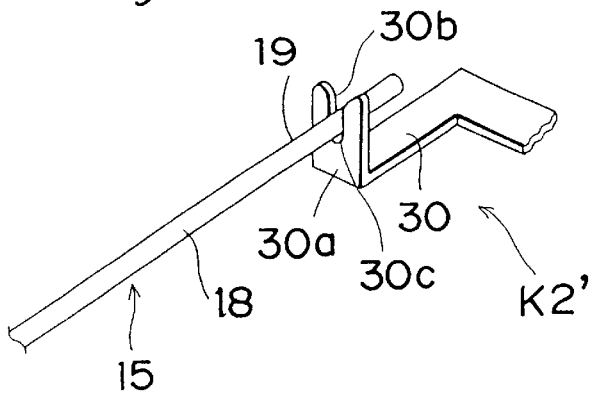
FIG. 11 is a perspective view similar to FIG. 10, particularly showing a modification of the electrical connection construction of FIG. 10.

FIG. 11 shows a modification K2' of the electrical connection construction K2 of FIG. 10. A portion of the horizontal bus bar 30 is bent vertically upwardly so as to form the external terminal portion 30*a* having a shape of a tab and a slot 30*b* is formed at an upper end portion of the external terminal portion 30*a* such that a pressing contact blade 30*c* is formed at a peripheral surface of the slots 30*b*. The pressing contact blade 30*c* of the bus bar 30 is thrust into the insulating coating 18 of the wire 15 of the wiring harness 40 so as to be brought into pressing contact with the conductor 19 of the wire 15, so that the wire 15 and the bus bar 30 are connected to each other without using a connector.

Figure 12:
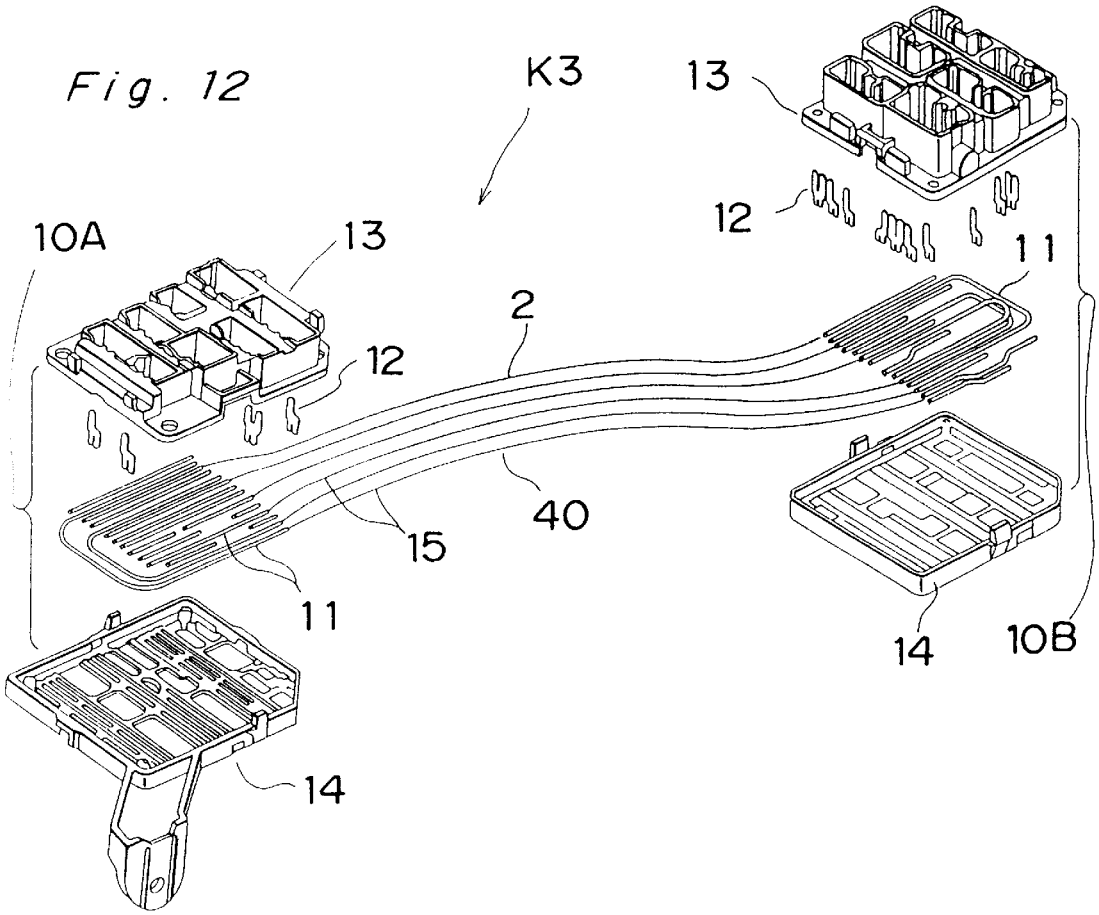
FIG. 12 is an exploded perspective view of an electrical connection construction of an electrical connection box, according to a third embodiment of the present invention.

FIG. 12 shows an electrical connection construction K3 according to a third embodiment of the present invention, in which electrical connection boxes 10A and 10B each formed by a junction box are connected to each other by a main line 2 of the wiring harness 40 without using a connector. The wires 15 of the wiring harness 40 are used by directly drawing the wires 11 of the internal circuit of the electrical connection box 10 out of openings 16 of the upper casing 13. Namely, the wires 11 of the internal circuit of the electrical connection box 10A are used as the wires 15 of the wiring harness 40 without being cut apart. These wires 15 of the wiring harness 40 are connected to the wires 11 of the internal circuit of the electrical connection box 10B in the same manner as the electrical connection box K1 or K2.

As is clear from the foregoing description, the following effects can be gained in the electrical connection boxes K1 to K3. Since the wires of the wiring harness are connected to the wires or the bus bars of the internal circuit of the electrical connection box without using a connector, terminals such as contact bonding terminals and pressing contact terminals, connectors for receiving these terminals, etc., which have been required to be used so far, are not required to be used at all. Meanwhile, since the connector is not used, a connector receiver is not required to be formed in the electrical connection box, so that the electrical connection box can be made compact in size and simple in shape, thereby resulting in reduction of space for installing the electrical connection box. Furthermore, when the wiring harness is produced, a step of connecting terminals to the wires of the wiring harness, respectively, a step of accommodating these terminals in connectors and a step of fitting these connectors into the electrical connection box can be eliminated. Since the number of components and the number of operational steps are reduced as described above, production cost of the electrical connection construction can be reduced greatly.

Meanwhile, the wires of the internal circuit of the electrical connection box and the wires of the wiring harness can be easily connected to each other without using a connector. Furthermore, the bus bars of the internal circuit of the electrical connection box and the wires of the wiring harness can be easily connected to each other without using a connector.

On the other hand, the two electrical connection boxes can be easily connected to each other without using a connector. Namely, if the wires of the internal circuit of one electrical connection box are drawn out of the one electrical connection box through the openings formed on the one electrical connection box so as to be used as the wires of the wiring harness, the need for connection between the wires of the internal circuit of the one electrical connection box and the wires of the wiring harness can be eliminated. Therefore, since the wires of the wiring harness may be connected to only the internal circuit of the other electrical connection box, the number of operational steps for producing the electrical connection construction and the number of components required for the electrical connection construction can be reduced greatly.

If the wires are directly drawn out of the main line of the wiring harness without using branch lines, hitherto frequently employed splicing of the wires of the wiring harness can be eliminated.

Figure 13:
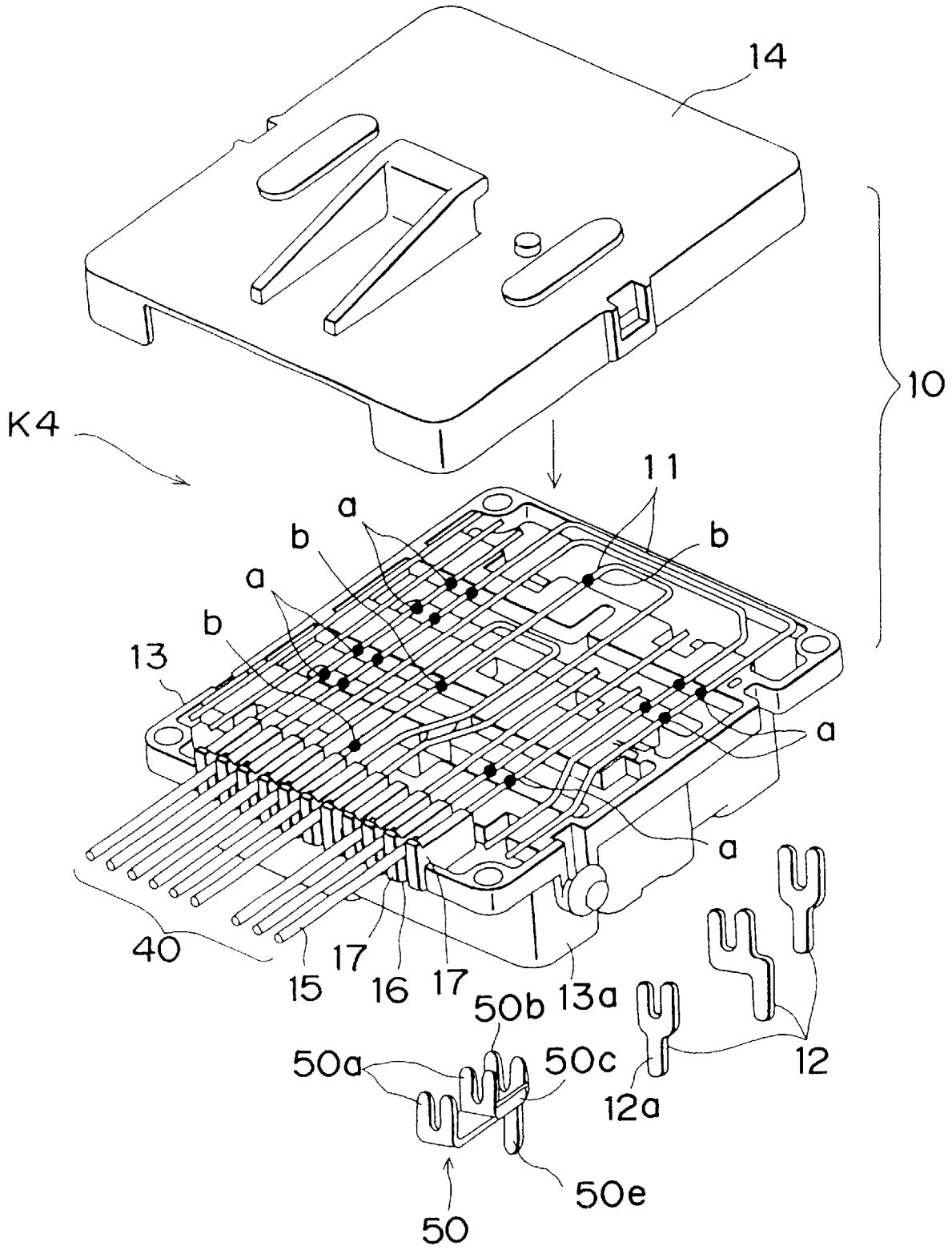
FIG. 13 is an exploded perspective view of an electrical connection construction of an electrical connection box, according to a fourth embodiment of the present invention.
Figure 14:
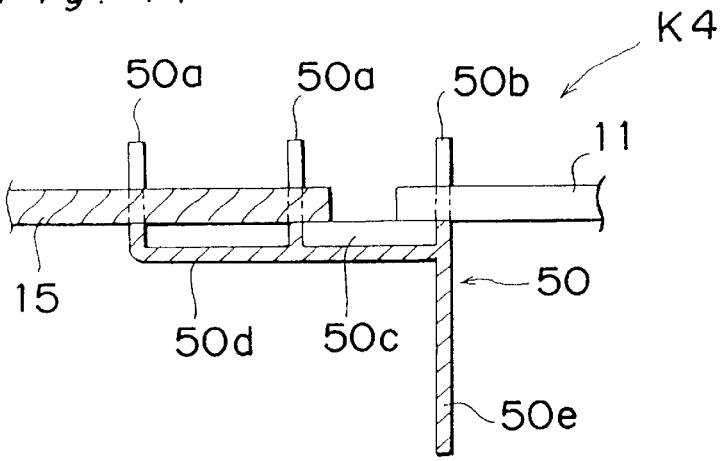
FIG. 14 is a sectional view of a pressing contact terminal employed in the electrical connection construction of FIG. 13.

FIGS. 13 and 14 show an electrical connection construction K4 of the electrical connection box 10, according to a fourth embodiment of the present invention in which the wires 15 of the wiring harness 40 are connected to the wires 11 of the internal circuit of the electrical connection box 10. In the electrical connection construction K4, the internal circuit of the electrical connection box 10 is constituted by the wires 11 and the pressing contact terminals 12 in the same manner as the electrical connection construction K1, while the pressing contact terminals 12 are driven into the wires 11 at locations a shown in FIG. 13. Each of the wires 15 of the wiring harness 40 has stranded conductors, while each of the wires 11 of the internal circuit of the electrical connection box 10 is formed by a single-conductor wire. Each of the wires 15 of the wiring harness 40 and each of the wires 11 of the internal circuit of the electrical connection box 10 are connected to each other by a pressing contact terminal 50.

Figure 15:
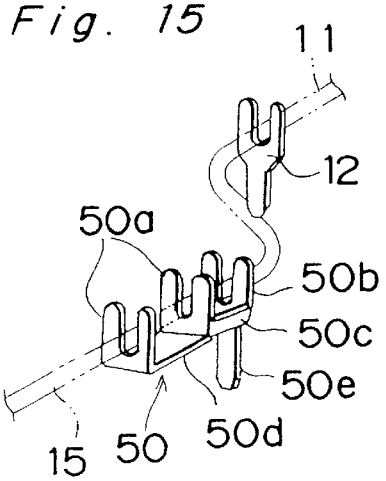
FIGS. 15 and 16 are fragmentary perspective views showing examples of installation of the pressing contact terminal of FIG. 14.
Figure 16:
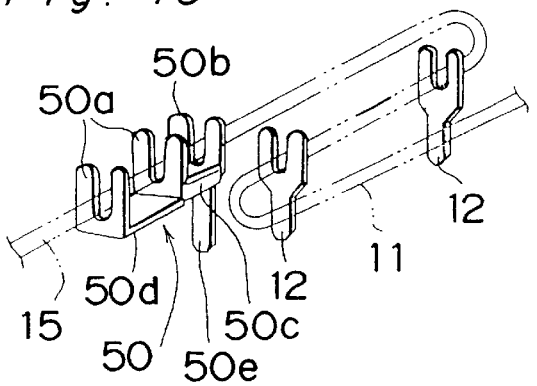

As shown in detail in FIGS. 14 to 16, the pressing contact terminal 50 includes a pair of pressing contact blades 50*a* which are thrust into the wire 15 of the wiring harness 40 so as to be brought into pressing contact with the conductors, a pressing contact blade 50*b* which is thrust into the wire 11 of the internal circuit of the electrical connection box 10 and a pair of side coupling portions 50*c* for integrally coupling the pressing contact blade 50*b* with one of the pressing contact blades 50*a* adjacent to the pressing contact blade 50*b*. The pressing contact blades 50*a* are arranged in a longitudinal direction of the wire 15 and are integrally coupled with each other by a bottom coupling portion 50*d*. In the same manner as the tab 12*a* of the pressing contact terminal 12, a tab 50*e* to be connected to an external terminal is integrally projected from a lower end of the pressing contact blade 50*b*.

The pressing contact terminals 50 are mounted on the upper casing 13 at arbitrary positions, for example, positions b shown in FIG. 13, which not only are convenient for connecting the wires 11 and 15 but allow the tab 50*e* to be inserted into one of the terminal holes provided in the upper casing 13. Meanwhile, in order to minimize the quantity of the wires 15 laid in the electrical connection box 10, it is preferable that the pressing contact terminal 50 is employed as a pressing contact terminal which is disposed closest to the openings 16. In the same manner as the tab 12*a* of the pressing contact terminal 12, the tab 50*e* of the pressing contact terminal 50 is projected into the connector receiver 13*a* from the terminal hole on the bottom face of the connector receiver 13*a* so as to be connected to a connector in the connector receiver. It is needless to say that the tab 50*e* of the pressing contact terminal 50 may also be projected into the relay connector or the fuse connector from the terminal hole on the bottom face of the relay connector or the fuse connector so as to be connected to a relay in the relay connector or a fuse in the fuse connector.

FIGS. 15 and 16 show examples of installation of the pressing contact terminal 50, in which a pair of the pressing contact blades 50*a* are brought into pressing contact with the wire 15 and the pressing contact blade 50*b* is brought into pressing contact with the wire 11 such that the wires 15 and 11 are connected to each other. After the wires 11 of the internal circuit of the electrical connection box 10 and the wires 15 of the wiring harness 40 have been connected to each other by the pressing contact terminals 50 as described above, the upper and lower casing 13 and 14 of the electrical connection box 10 are assembled with each other.

In the electrical connection construction K4 between the electrical connection box 10 and the wiring harness 40, the wires 15 of the wiring harness 40 can be connected to the wires 11 of the internal circuit of the electrical connection box 10 prior to wiring in a vehicle body without using a connector. Therefore, such hitherto necessary operations can be eliminated that terminals are, respectively, attached to the wires 15 of the wiring harness 40, the terminals are accommodated in a connector and the connector is fitted into the connector receiver of the electrical connection box 10. Meanwhile, since the number of the connector receivers provided on the electrical connection box is reduced, the electrical connection box 10 can be made compact in size and simple in structure.

Meanwhile, since the wires 11 of the electrical connection box 10 and the wires 15 of the wiring harness 40 can be connected to each other remarkably simply by the pressing contact terminals 50 through one-step operation and each of the pressing contact terminals 50 can be provided at an arbitrary position convenient for its connection by using one of the terminal holes formed on the upper casing 13 of the electrical connection box 10, degree of freedom of locations for connecting the wires 11 and 15 is increased.

As will be seen from the foregoing description, the following effects can be achieved in the electrical connection construction K4. Since the wires of the wiring harness and the wires of the internal circuit of the electrical connection box are, respectively, connected to each other by the pressing contact terminals provided at the proper locations in the electrical connection box, the wires of the wiring harness and the wires of the internal circuit of the electrical connection box can be connected to each other without using a connector. Therefore, since all such operations can be eliminated that terminals are, respectively, attached to the wires of the wiring harness, the terminals are accommodated in a connector and the connector is fitted into the connector receiver of the electrical connection box, inconveniences resulting from defective fitting of the connector into the connector receiver or failure to fit the connector into the connector receiver are obviated. Furthermore, since the number of the connector receivers provided on the electrical connection box can be reduced, the electrical connection box can be made compact in size and simple in structure.

Meanwhile, since the wires of the internal circuit of the electrical connection box and the wires of the wiring harness can be connected to each other quite simply by the pressing contact terminals through one-step operation without using a connector and each of the pressing contact terminals can be provided at an arbitrary position convenient for its connection by employing one of the terminal holes provided on the upper casing of the electrical connection box, degree of freedom of locations for connecting the wires of the internal circuit of the electrical connection box and the wires of the wiring harness is increased.

Moreover, in case each of the wires of the wiring harness has stranded conductors, a pair of the pressing contact blades provided in the longitudinal direction of each of the pressing contact terminals can be positively brought into contact with the stranded conductors of each of the wires of the wiring harness.

What is claimed is:

1. An electrical connection construction comprising: an electrical connection box including conductive members of an internal circuit, the electrical connection box including at least one outer peripheral wall, the conductive members of the internal circuit are, respectively, formed by further wires which form a conductive pattern, the further wires forming the internal circuit within the electrical connection box, wires of a wiring harness being inserted into the electrical connection box through openings formed in said at least one outer peripheral wall of the electrical connection box, each opening including opposed elongated partition walls having a predetermined length, and distal end portions of conductors of the wires of the wiring harness being connected to distal end portions of the further wires of the internal circuit by a joining connection only inside the openings of the electrical connection box, the joining connection having a length less than the predetermined length of the partition walls, wherein the joining connection is located only within the predetermined length and between respective opposed partition walls.

2. An electrical connection construction as claimed in claim 1, wherein the joining connection is welding.

3. An electrical connection construction as claimed in claim 1, wherein the joining connection is formed by pressing contact terminals.

4. An electrical connection construction as claimed in claim 2, wherein the conductors exposed at the distal end portions of the wires of the wiring harness and further conductors exposed at the distal end portions of the further wires of the internal circuit of the electrical connection box, respectively, are welded to each other.

5. An electrical connection construction as claimed in claim 1, wherein the wires of the wiring harness are formed by wires of a main line of the wiring harness.

6. An electrical connection construction as claimed in claim 1, wherein each of the wires of the wiring harness has stranded conductors and each of the further wires of the internal circuit of the electrical connection box has a single conductor;

wherein each of the pressing contact terminals includes a pair of first pressing contact blades brought into pressing contact with two locations of each of the wires of the wiring harness spaced in a longitudinal direction of each of the wires of the wiring harness, respectively and a second pressing contact blade brought into pressing contact with each of the further wires of the internal circuit of the electrical connection box.

7. An electrical connection construction for connecting wires of a first internal circuit of a first electrical connection box and conductive members of a second internal circuit of a second electrical connection box, the second internal circuit forming a conductive pattern, the second electrical connection box including at least one outer peripheral wall, the electrical connection construction comprising: the wires of the first internal circuit of the first electrical connection box being drawn out of the first electrical connection box through openings formed on the first electrical connection box and being inserted into the second electrical connection box through openings formed in said at least one outer peripheral wall of the second electrical connection box, distal end portions of conductors of the wires of the first internal circuit being connected by a joining connection only inside the openings of the second electrical connection box to distal end portions of the conductive members of the second internal circuit of the second electrical connection box, the conductive members of the second internal circuit are, respectively, formed by further wires, the further wires forming said internal circuit within the second electrical connection box, each opening of the second electrical connection box including opposed elongated partition walls having a predetermined length and the joining connection having a length less than the predetermined length of the partition walls, wherein the joining connection is located only within the predetermined length and between respective opposed partition walls.

8. An electrical connection construction as claimed in claim 7, wherein the joining connection is welding.

9. An electrical connection construction as claimed in claim 7, wherein the joining connection is formed by pressing contact terminals.

10. An electrical connection construction comprising: an electrical connection box including conductive members of an internal circuit, the electrical connection box including at least one outer peripheral wall, the conductive members of the internal circuit are, respectively, formed by bus bars which form a conductive pattern, the bus bars forming said internal circuit within the electrical connection box, wires of a wiring harness being inserted into the electrical connection box through openings formed in said at least one outer peripheral wall of the electrical connection box, each opening including opposed elongated partition walls having a predetermined length, and distal end portions of conductors of the wires of the wiring harness being connected to distal end portions of the conductive members of the internal circuit by a joining connection only inside the openings of the electrical connection box by the joining connection, the joining connection having a length less than the predetermined length of the partition walls, wherein the joining connection is located only within the predetermined length and between respective opposed partition walls.

11. An electrical connection construction as claimed in claim 10, wherein the bus bars of the internal circuit of the electrical connection box and the conductors exposed at the distal end portions of the wires of the wiring harness, respectively, are welded to each other.

12. An electrical connection construction as claimed in claim 10, wherein each of the bus bars of the internal circuit of the electrical connection box includes an external terminal portion having a pressing contact blade such that the external terminal portion of each of the bus bars of the internal circuit of the electrical connection box is brought into pressing contact with each of the wires of the wiring harness.

13. An electrical connection construction for connecting wires of a first internal circuit of a first electrical connection box and conductive members of a second internal circuit of a second electrical connection box, the second internal circuit forming a conductive pattern, the second electrical connection box including at least one outer peripheral wall, the electrical connection construction comprising: the wires of the first internal circuit of the first electrical connection box being drawn out of the first electrical connection box through openings formed on the first electrical connection box and being inserted into the second electrical connection box through openings formed in said at least one outer peripheral wall of the second electrical connection box, distal end portions of conductors of the wires of the first internal circuit being connected by a joining connection only inside the openings of the second electrical connection box to distal end portions of the conductive members of the second internal circuit of the second electrical connection box by the joining connection, the conductive members of the second internal circuit are, respectively, formed by bus bars, the bus bars forming said internal circuit within the second electrical connection box, each opening of the second electrical connection box including opposed elongated partition walls having a predetermined length and the joining connection having a length less than the predetermined length of the partition walls, wherein the joining connection is located only within the predetermined length and between respective opposed partition walls.

14. An electrical construction as claimed in claim 13, wherein the conductive members of the second internal circuit of the second electrical connection box are, respectively, formed by bus bars and each of the bus bars of the second internal circuit of the second electrical connection box includes an external terminal portion having a pressing contact blade such that the external terminal portion of each of the bus bars of the second internal circuit of the second electrical connection box is brought into pressing contact with each of the wires of the first internal circuit of the first electrical connection box.

* * * * *